US007389713B1

(12) United States Patent
Chen

(10) Patent No.: US 7,389,713 B1
(45) Date of Patent: Jun. 24, 2008

(54) ADJUSTABLE SOCKET FOR USE WITH A SOCKET WRENCH

(76) Inventor: Joe Chen, 3F., No. 146, Dongming Rd., Dali City, Taichung County 412 (TW)

( * ) Notice: Subject to any disclaimer, the term of this patent is extended or adjusted under 35 U.S.C. 154(b) by 0 days.

(21) Appl. No.: 11/743,879

(22) Filed: May 3, 2007

(51) Int. Cl.
*B25B 13/16* (2006.01)

(52) U.S. Cl. ..... 81/155; 81/165

(58) Field of Classification Search ..... 81/155–172, 81/128, 129, 179, 176.3, 121.1
See application file for complete search history.

(56) References Cited

U.S. PATENT DOCUMENTS 82,627 A * 9/1868 Munger ..... 81/155
2,801,562 A * 8/1957 Stricklett et al. ..... 81/163
4,136,588 A * 1/1979 Roder ..... 81/165
6,662,689 B1 * 12/2003 Voskanyan ..... 81/163
6,715,385 B2 * 4/2004 Wu ..... 81/163
2006/0042424 A1 * 3/2006 Pirseyedi ..... 81/163
2006/0225539 A1 * 10/2006 Chen ..... 81/163

* cited by examiner

*Primary Examiner*—Hadi Shakeri

(57) ABSTRACT

An adjustable socket for use with a socket wrench is disclosed that includes opposite first and second clamping units having an outer surface adapted to closely engage an inner surface of the socket and including an inner groove for securely engaging a bolt or nut, and a transverse threaded through hole; first and second threaded fastening units adapted to drive through the socket and the first and second clamping units to be threadedly secured together; and a guide for guiding transverse movements of the first and the second clamping units such that turning at least one of the first and the second fastening units will move the first and second clamping units closer each other or move them away from each other. The socket having an adjustable inside diameter is adapted to fit many different sizes of bolts or nuts.

4 Claims, 6 Drawing Sheets

ADJUSTABLE SOCKET FOR USE WITH A SOCKET WRENCH

BACKGROUND OF THE INVENTION

1. Field of Invention

The invention relates to sockets for use with a socket wrench and more particularly to such a socket having an adjustable inside diameter so as to fit many different sizes of bolts or nuts.

2. Description of Related Art

A conventional socket has two open ends in which one end (i.e., driven end) is adapted to fit a socket wrench and the other end (i.e., drive end) is adapted to fit a hexagonal bolt head (or nut). Thus, a user can rotate the socket wrench to fasten or unfasten the bolt.

The drive end of the conventional socket comprises interior engagement surfaces for engaging a bolt head. The drive end has a fixed inside diameter. Hence, such conventional socket can only fit a bolt of specific size.

It is known that there are many different sizes of bolts commercially available. This means that a user (e.g., a worker) has to prepare many different sizes of sockets in order to drive each of the bolts. This can bear a great financial burden on the user. Also, this is very inconvenient and annoying since, for example, the worker has to stop an ongoing job if a specific sized socket is not at hand during work. Hence, a need has arisen for a socket having an adjustable inside diameter so as to fit many different sizes of bolts or nuts.

SUMMARY OF THE INVENTION

It is therefore one object of the invention to provide a socket for use with a socket wrench, the socket having an adjustable inside diameter so as to fit many different sizes of bolts or nuts.

To achieve the above and other objects, the invention provides a socket comprising a hollow cylinder having one end adapted to fit a socket wrench and the other end adapted to fit a fitting or a fastener; a first clamping unit having an outer surface adapted to closely engage an inner surface of the cylinder and including a groove on an inner surface, the groove being adapted to securely engage the fitting or the fastener, and a transverse threaded through hole; a second clamping unit opposing the first clamping unit and having an outer surface adapted to closely engage the inner surface of the cylinder, the second clamping unit including a groove on an inner surface, the groove being adapted to securely engage the fitting or the fastener, and a transverse threaded through hole; a first fastening unit including an enlarged head, a threaded shank, and a projecting bar at an end of its shank; a second fastening unit including an enlarged head, a threaded shank, and a hole in its shank; and a guide unit for guiding a transverse movement of each of the first and the second clamping units, wherein the first fastening unit is adapted to transversely drive through the cylinder and the through hole of the first clamping unit to threadedly secure the first fastening unit and the first clamping unit together; the second fastening unit is adapted to transversely drive through the cylinder and the through hole of the second clamping unit to threadedly secure the second fastening unit and the second clamping unit together and have the hole put on the bar; in response to clockwise turning one of the first and the second fastening units either the first clamping unit moves toward the second clamping unit or the second clamping unit moves toward the first clamping unit; and in response to counterclockwise turning one of the first and the second fastening units either the first clamping unit moves away from the second clamping unit or the second clamping unit moves away from the first clamping unit.

In one aspect of the invention the head of each of the first and the second fastening units is knurled and comprises a hexagonal cavity on an outer end.

In another aspect of the invention the guide unit comprises a pin driven through the cylinder and the first and the second clamping units, and a C-shaped ring for fastening an end of the pin.

In a further aspect of the invention each of the first and the second clamping units includes an longitudinal ridge on its outer surface, the guide unit comprises two opposite longitudinal troughs on the inner surface of the cylinder, and the troughs are adapted to fit over the ridges.

The above and other objects, features and advantages of the invention will become apparent from the following detailed description taken with the accompanying drawings.

DETAILED DESCRIPTION OF THE INVENTION

Figure 1:
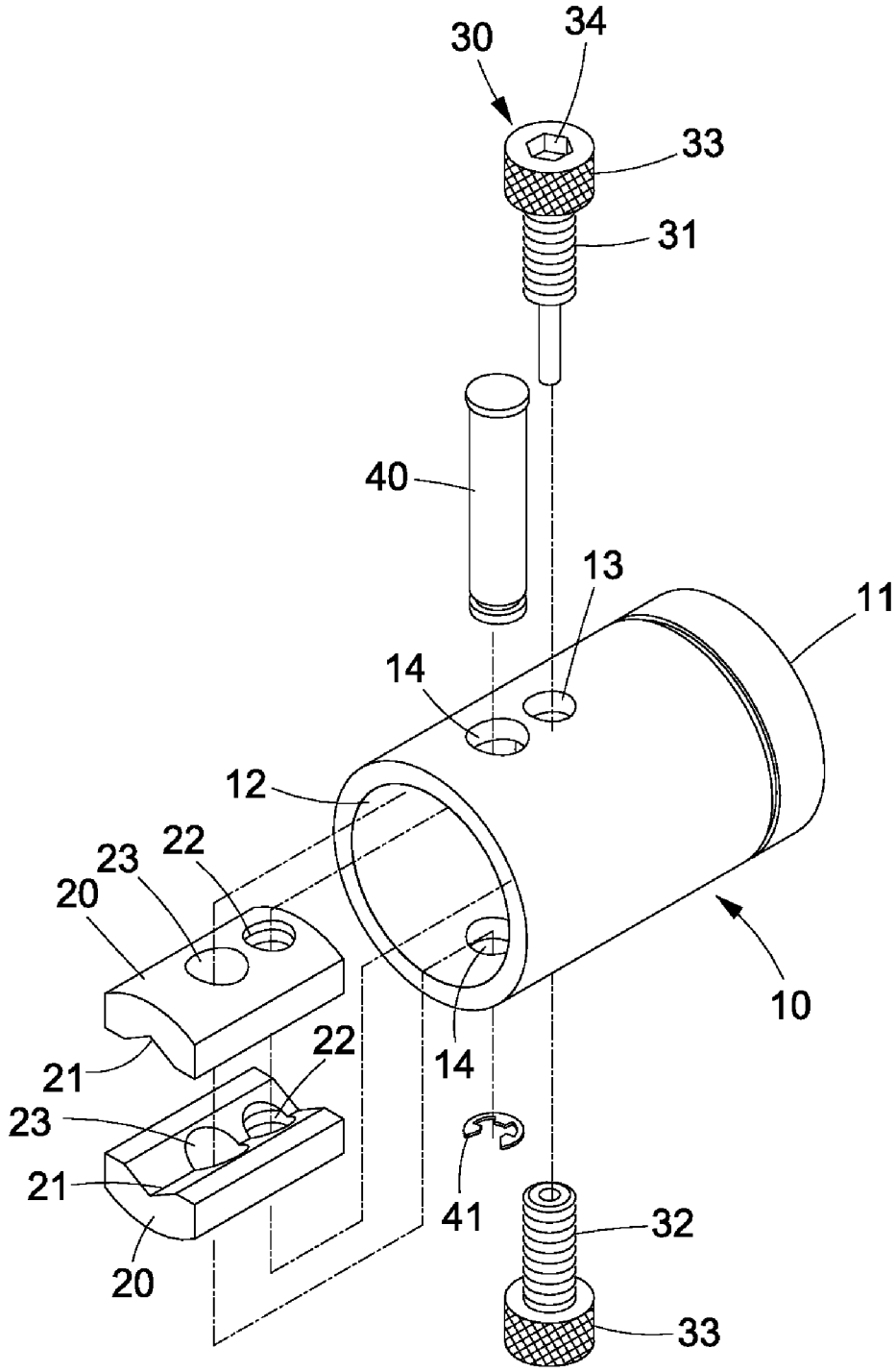
FIG. 1 is an exploded view of a first preferred embodiment of adjustable socket for use with a socket wrench according to the invention.
Figure 2:
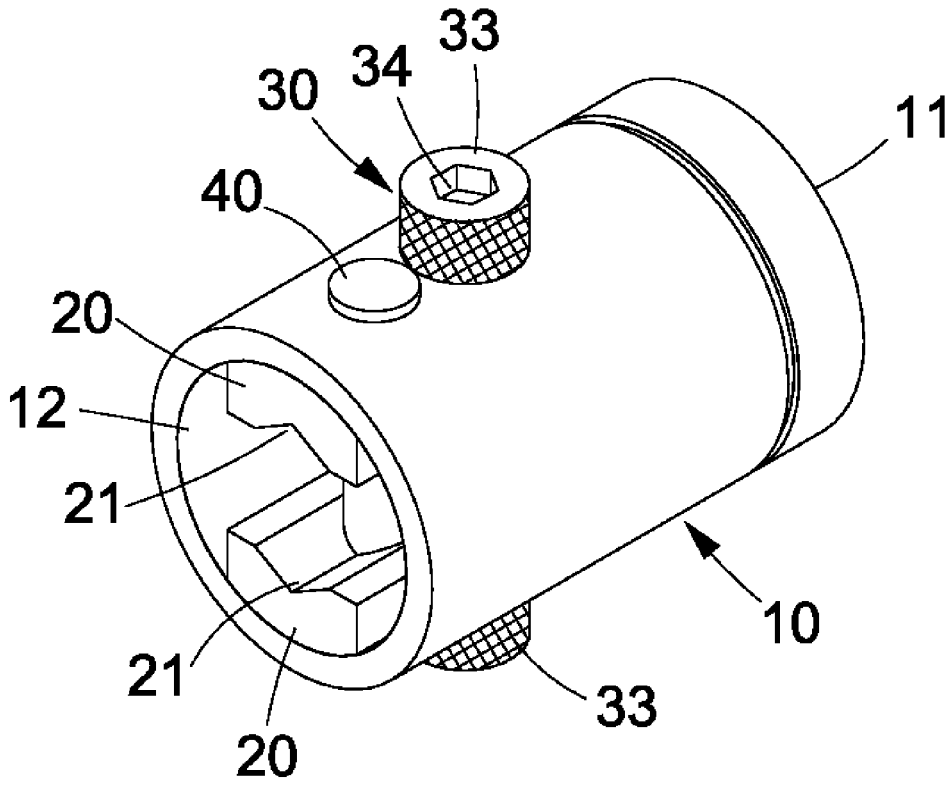
FIG. 2 is a perspective view of the assembled socket.

Referring to FIGS. 1 to 4, an adjustable socket in accordance with a preferred embodiment of the invention comprises a cylindrical body 10 having two open ends 11, 12 in which one end (i.e., driven end) 11 is adapted to fit a socket wrench (not shown) and the other end (i.e., drive end) 12 is adapted to fit one of many different sizes of bolts (or nuts) as detailed below. In use, a user can rotate the socket wrench to fasten or unfasten the bolt as known in the art.

The body 10 comprises a transverse first through hole 13 between both ends 11 and 12, and a transverse second through hole 14 between the drive end 12 and the first through hole 13.

Within the drive end 12 there are provided upper and lower clamping pieces 20 of slight curved section. Each of the upper and lower clamping pieces 20 comprises an inner longitudinal V-shaped groove 21, a transverse threaded through hole 22 proximate an inner end, and a transverse through hole 23 between an outer end and the threaded through hole 22.

A pin 40 is adapted to insert through one end of the second through hole 14, the through hole 23 of the upper clamping piece 20, the through hole 23 of the lower clamping piece 20, and the other end of the second through hole 14 to be fastened by a C-ring 41 on the outer surface of the body 10. The diameter of the pin 40 is slightly smaller than that of the through hole 23 so that both the upper and the lower clamping piece 20 are adapted to smoothly slide along the pin 40.

There are further provided a threaded fastener 30 including two members 31 and 32 in which one member 31 comprises an enlarged knurled head 33, a hexagonal cavity 34 on an outer end of the head 33, a threaded shank (not numbered), and a projecting bar (not numbered) at an end of the shank; and the other member 32 comprises an enlarged knurled head 33, a hexagonal cavity 34 on an outer end of the head 33, a threaded shank (not numbered), and a hole (not numbered) in the shank.

One member 31 is adapted to drive through one end of the first through hole 13 and the threaded through hole 22 of the upper clamping piece 20 to be threadedly secured to the upper clamping piece 20 and the other member 32 is adapted to drive through the opposite other end of the first through hole 13 and the threaded through hole 22 of the lower clamping piece 20 to be threadedly secured to the lower clamping piece 20 until the bar is completely fitted in the hole with the heads 33 engaging the outer surface of the body 10.

An adjustment operation of the invention will be described in detail below by referring to FIGS. 3 and 4 specifically. In one exemplary example, a user may either fit a hex key in the cavity 34 of one member 31 or tightly hold the head 33 thereof to counterclockwise turn one member 31 so as to threadedly move the upper clamping piece 20 toward the lower clamping piece 20 until a small bolt 50 (i.e., the bolt head) is fastened by the opposite grooves 21 (see FIG. 4).

Figure 3:
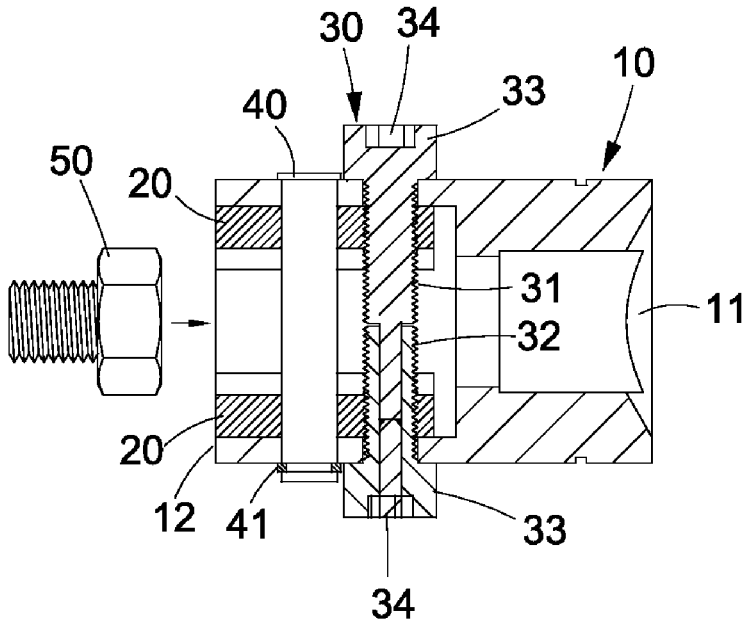
FIG. 3 is a longitudinal sectional view of FIG. 2 where the socket has been adjusted to fit a bolt with a larger head.
Figure 4:
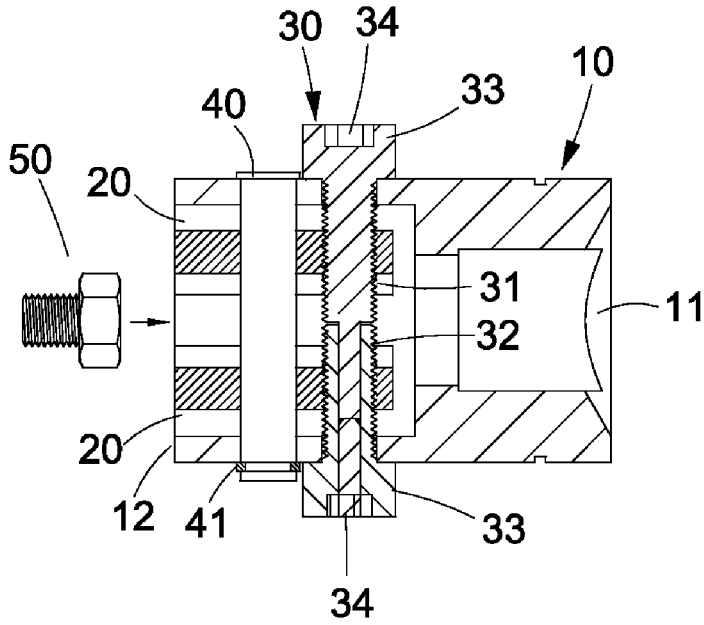
FIG. 4 is a view similar to FIG. 3 where the socket has been further adjusted to fit a bolt with a smaller head.
Figure 5:
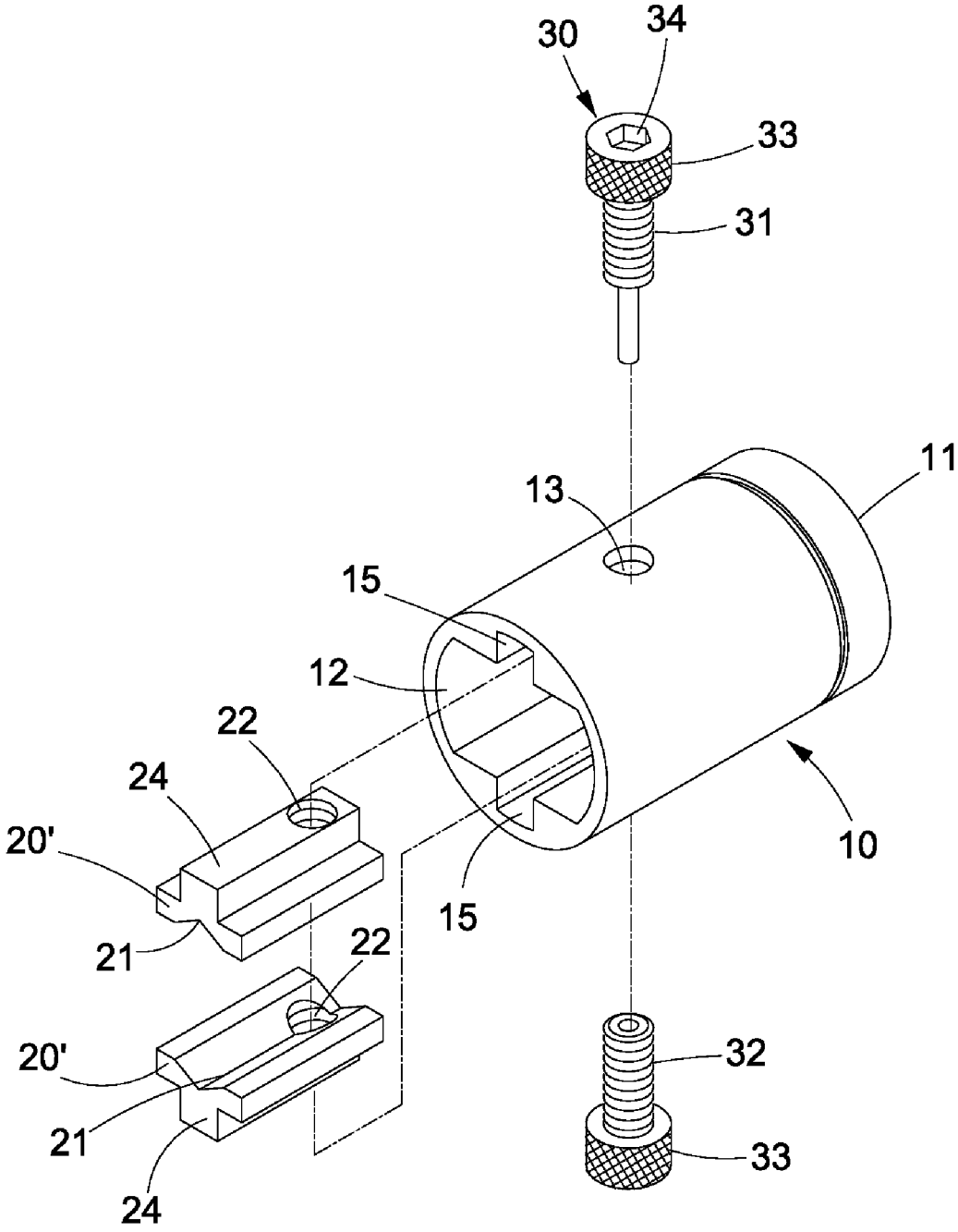
FIG. 5 is an exploded view of a second preferred embodiment of adjustable socket for use with a socket wrench according to the invention.
Figure 6:
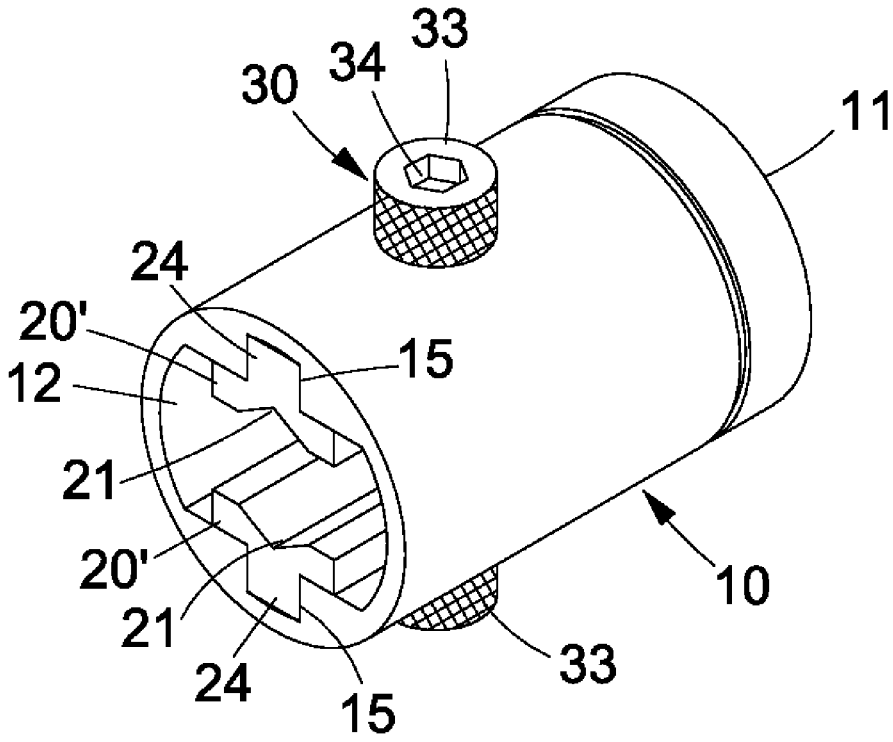
FIG. 6 is a perspective view of the assembled socket shown in FIG. 5.

Alternatively, a user may clockwise turn one member 31 so as to threadedly move the upper clamping piece 20 away from the lower clamping piece 20 until a large bolt 50 (i.e., the bolt head) is fastened by the opposite grooves 21 (see FIG. 3).

In short, it is possible of tightly engaging the socket of the invention with one of a plurality of different sized bolts or nuts by a threaded adjustment.

Referring to FIGS. 5 to 8, an adjustable socket in accordance with a second preferred embodiment of the invention is shown. The characteristics of the second preferred embodiment are detailed below. The body 10 comprises a single transverse through hole 13. Each of the upper and lower clamping pieces 20' includes an longitudinal ridge 24 of rectangular section on an outer surface and a transverse threaded through hole 22 proximate its inner end.

The pin 40 is eliminated. An inner surface of the hollow body 10 has a substantially cross section, i.e., having a large transverse hollow part (i.e., channel) and two small vertical hollow parts (i.e., troughs) 15 which each is dimensioned and shaped to fit snugly over the ridge 24 so that the ridges 24 (i.e., the upper and lower clamping pieces 20') are adapted to slide into or out of the body 10.

Figure 7:
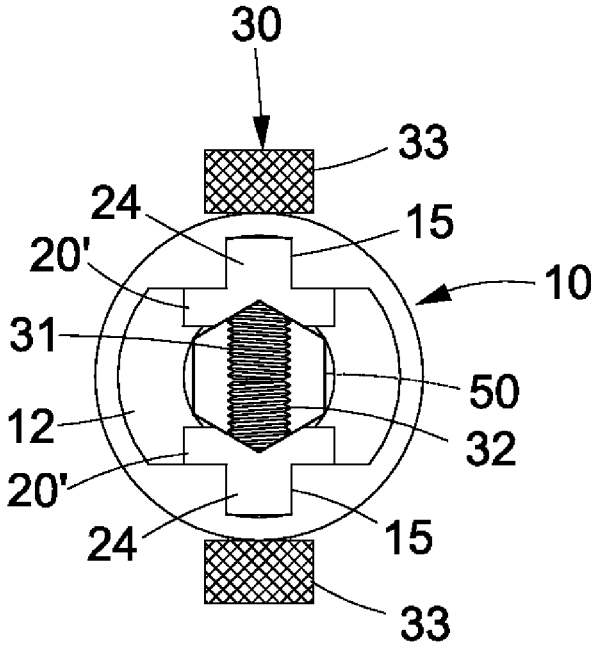
FIG. 7 is a longitudinal sectional view of FIG. 6 where the socket has been adjusted to fit a bolt with a larger head.
Figure 8:
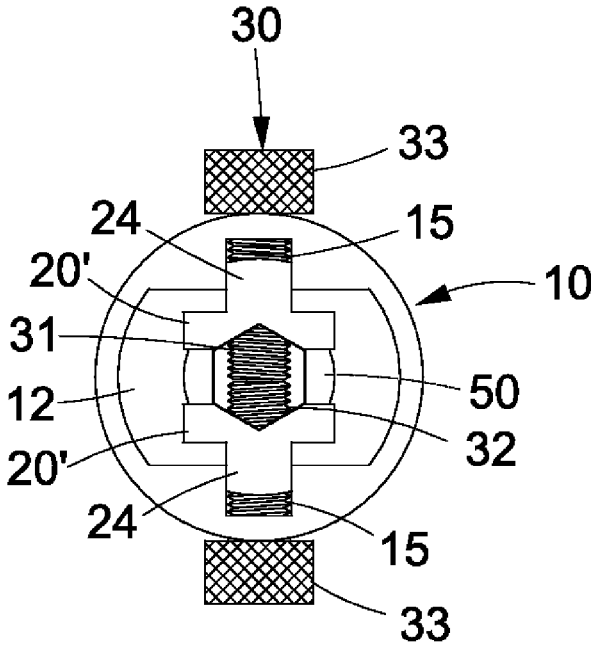
FIG. 8 is a view similar to FIG. 7 where the socket has been further adjusted to fit a bolt with a smaller head.

A simple adjustment operation by turning either member 31 or 32 can either threadedly move the upper clamping piece 20' toward the lower clamping piece 20' for fastening a small bolt 50 by the opposite grooves 21 (see FIG. 8) or threadedly move the upper clamping piece 20' away from the lower clamping piece 20' for fastening a large bolt 50 by the opposite grooves 21 (see FIG. 7).

While the invention herein disclosed has been described by means of specific embodiments, numerous modifications and variations could be made thereto by those skilled in the art without departing from the scope and spirit of the invention set forth in the claims.

What is claimed is:

1. A socket comprising:

a hollow cylinder having one end adapted to fit a socket wrench and the other end adapted to fit a fitting or a fastener;

a first clamping unit having an outer surface adapted to closely engage an inner surface of the cylinder and including a groove on an inner surface, the groove being adapted to securely engage the fitting or the fastener, and a transverse threaded through hole;

a second clamping unit opposing the first clamping unit and having an outer surface adapted to closely engage the inner surface of the cylinder, the second clamping unit including a groove on an inner surface, the groove being adapted to securely engage the fitting or the fastener, and a transverse threaded through hole;

a first fastening unit including an enlarged head, a threaded shank, and a projecting bar at an end of its shank;

a second fastening unit including an enlarged head, a threaded shank, and a hole in its shank; and a guide unit for guiding a transverse movement of each of the first and the second clamping units, wherein:

the first fastening unit is adapted to transversely drive through the cylinder and the through hole of the first clamping unit to threadedly secure the first fastening unit and the first clamping unit together;

the second fastening unit is adapted to transversely drive through the cylinder and the through hole of the second clamping unit to threadedly secure the second fastening unit and the second clamping unit together and sleeve the hole on the bar;

in response to clockwise turning one of the first and the second fastening units either the first clamping unit moves toward the second clamping unit or the second clamping unit moves toward the first clamping unit; and in response to counterclockwise turning one of the first and the second fastening units either the first clamping unit moves away from the second clamping unit or the second clamping unit moves away from the first clamping unit.

2. The socket of claim 1, wherein the head of each of the first and the second fastening units is knurled and comprises a hexagonal cavity on an outer end.

3. The socket of claim 1, wherein the guide unit comprises a pin driven through the cylinder and the first and the second clamping units, and a C-shaped ring for fastening an end of the pin.

4. The socket of claim 1, wherein each of the first and the second clamping units includes a longitudinal ridge on its outer surface, the guide unit comprises two opposite longitudinal troughs on the inner surface of the cylinder, and the troughs are adapted to fit over the ridges.

* * * * *